US009688069B2

(12) United States Patent
Tamura et al.

(10) Patent No.: US 9,688,069 B2
(45) Date of Patent: Jun. 27, 2017

(54) LIQUID DISCHARGE APPARATUS AND LIQUID DISCHARGE HEAD

(71) Applicant: CANON KABUSHIKI KAISHA, Tokyo (JP)

(72) Inventors: Yasuyuki Tamura, Yokohama (JP); Masato Yajima, Utsunomiya (JP); Yasuto Kodera, Fujisawa (JP); Naoto Sasagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/821,093

(22) Filed: Aug. 7, 2015

(65) Prior Publication Data

US 2016/0059554 A1 Mar. 3, 2016

(30) Foreign Application Priority Data

Aug. 29, 2014 (JP) ..... 2014-175514

(51) Int. Cl.
*B41J 2/04* (2006.01)
*B41J 2/14* (2006.01)
*B41J 2/045* (2006.01)

(52) U.S. Cl.
CPC ..... *B41J 2/14201* (2013.01); *B41J 2/04525* (2013.01); *B41J 2/04581* (2013.01); (Continued)

(58) Field of Classification Search
None
See application file for complete search history.

(56) References Cited

U.S. PATENT DOCUMENTS 5,801,732 A 9/1998 Pengelly
7,008,049 B2 3/2006 Katayama
(Continued)

FOREIGN PATENT DOCUMENTS

CN 1749012 A 3/2006
CN 2794828 Y 7/2006
(Continued)

OTHER PUBLICATIONS

Yamamoto, Teppei, Liquid Ejector, Oct. 23, 2008, Japan, pp. 1-20.*
(Continued)

*Primary Examiner* — Matthew Luu
*Assistant Examiner* — Tracey McMillion
(74) *Attorney, Agent, or Firm* — Fitzpatrick, Cella, Harper & Scinto

(57) ABSTRACT

A liquid discharge apparatus including a liquid discharge head having a substrate, plural pressure chambers two-dimensionally provided on one surface of the substrate, a discharge port, a pressure generating unit to discharge liquid through the discharge port and a flow path connected to the pressure chamber which are provided correspondingly to each pressure chamber, a common liquid chamber provided on the other surface of the substrate, and plural supply paths provided between adjacent pressure chambers and connected to the common liquid chamber; a moving unit to relatively move the liquid discharge head and a recording object; and a driving unit to drive the pressure generating unit. Flow paths respectively corresponding to the pressure chambers adjacent to the supply paths are connected to the supply paths. The driving unit outputs drive signals to the pressure generating units respectively corresponding to the pressure chambers connected to the supply paths at different timings.

14 Claims, 7 Drawing Sheets

(52) U.S. Cl.
CPC .. *B41J 2/14233* (2013.01); *B41J 2002/14419* (2013.01); *B41J 2002/14459* (2013.01); *B41J 2202/11* (2013.01); *B41J 2202/20* (2013.01)

(56) References Cited

U.S. PATENT DOCUMENTS

| | | | | |
|---|---|---|---|---|
| 7,445,306 | B2 | 11/2008 | Hirota | |
| 7,556,338 | B2 | 7/2009 | Iriguchi | |
| 8,038,245 | B2 | 10/2011 | Iwao et al. | |
| 8,517,518 | B2 * | 8/2013 | Kashu et al. | B41J 2/1404 347/66 |
| 8,696,093 | B2 | 4/2014 | Ozawa et al. | |
| 8,794,746 | B2 | 8/2014 | Kashu et al. | |
| 9,108,425 | B2 | 8/2015 | Kashu et al. | |
| 2005/0190221 | A1 | 9/2005 | Iriguchi | |
| 2007/0200889 | A1 * | 8/2007 | Iriguchi | B41J 2/04525 347/19 |
| 2012/0113197 | A1 | 5/2012 | Kashu et al. | |
| 2014/0191062 | A1 | 7/2014 | Sasagawa et al. | |

FOREIGN PATENT DOCUMENTS

| | | | | |
|---|---|---|---|---|
| CN | 102310637 | A | | 1/2012 |
| CN | 103342051 | A | | 10/2013 |
| EP | 1 634 705 | A1 | | 3/2006 |
| JP | 09-156095 | A | | 6/1997 |
| JP | 2000-238248 | A | | 9/2000 |
| JP | 2006-123397 | A | | 5/2006 |
| JP | 2007-168431 | A | | 7/2007 |
| JP | 2008254198 | A | * | 10/2008 |
| JP | 2012-045889 | A | | 3/2012 |

OTHER PUBLICATIONS

Extended European Search Report dated May 23, 2016, in European Patent Application No. 15002422.2.
Partial Search Report issued in European Patent Application No. 15002422.2, dated Feb. 5, 2016.
Office Action dated Jul. 15, 2016, in Chinese Application No. 201510547570.7.

* cited by examiner

LIQUID DISCHARGE APPARATUS AND LIQUID DISCHARGE HEAD

BACKGROUND OF THE INVENTION

Field of the Invention

The present invention relates to a liquid discharge apparatus and a liquid discharge head.

Description of the Related Art

A liquid discharge apparatus configured to conduct recording by discharging, from a liquid discharge head for discharging liquid such as ink, a liquid onto a recording object is required to conduct a more accurate recording at high speed. A liquid discharge head includes a mechanism configured to discharge liquid (hereinafter referred to as discharge mechanism portion) including a pressure chamber, a discharge port communicating with the pressure chamber, a pressure generating unit that is provided for the pressure chamber and is configured to generate a pressure for discharging liquid through a discharge port, and a flow path connected to the pressure chamber. In order to meet the requirement described above, it has been proposed to two-dimensionally arrange a large number of the discharge mechanism portions in a substrate of the liquid discharge head.

In Japanese Patent Application Laid-Open No. 2012-045889, there is disclosed a liquid discharge head including a plurality of discharge mechanism portions that are two-dimensionally arranged and a plurality of supply paths (liquid introducing chambers) connected to a common liquid chamber (manifold) for storing liquid. In the liquid discharge head disclosed in Japanese Patent Application Laid-Open No. 2012-045889, pressure chambers of the large number of discharge mechanism portions are connected to each of the plurality of supply paths.

Further, in Japanese Patent Application Laid-Open No. 2006-123397, there is disclosed a liquid discharge head including a plurality of discharge mechanism portions that are two-dimensionally arranged and a plurality of common liquid chambers (auxiliary manifolds), in which pressure chambers of the plurality of discharge mechanism portions are connected to each of the common liquid chambers via flow paths. In the liquid discharge head disclosed in Japanese Patent Application Laid-Open No. 2006-123397, a plurality of pressure chamber arrays each including a plurality of pressure chambers are assigned to one common liquid chamber, and the pressure chambers that belong to the plurality of pressure chamber arrays are connected to the one common liquid chamber. Pressure generating units (actuators) of pressure chambers that belong to pressure chamber arrays adjacent to each other among the plurality of pressure chamber arrays assigned to the one common liquid chamber are driven at different timings.

In a liquid discharge head in which a large number of discharge mechanism portions are arranged at high density, there is a problem in that the discharge mechanism portions (pressure generating units) interfere with each other due to a pressure fluctuation occurring when the discharge mechanism portions are driven, and thus, a discharge state of liquid of the discharge mechanism portions fluctuates to lower quality of the recording. Further, when discharge mechanism portions of a large number of pressure chambers are electrically driven at the same time, there is a problem in that a peak value of drive power becomes larger, and thus, the discharge state of the discharge mechanism portions fluctuates due to a voltage drop or the like to lower the quality of the record.

In the liquid discharge head disclosed in Japanese Patent Application Laid-Open No. 2012-045889, in order to prevent a pressure wave generated in one pressure chamber from directly propagating to another pressure chamber, the pressure chambers are arranged so that openings of flow reducing portions connecting a pressure chamber and a supply path are not opposed to each other. However, interference among the discharge mechanism portions also occurs due to other factors than propagation of a pressure wave.

Specifically, at a time when a pressure chamber is pressurized by a pressure generating unit to discharge liquid, the liquid flows back through a flow reducing portion and flows into a supply path to increase the pressure in the supply path. The extent of the pressure increase in the supply path depends on the number of discharge mechanism portions that are driven at the same time. Therefore, not only does the discharge state of the discharge mechanism portions that are driven at the same time fluctuate, but also menisci of discharge mechanism portions that are not driven fluctuate to affect the subsequent discharge. Further, immediately after liquid is discharged, the liquid is supplied toward a discharge mechanism portion that has discharged the liquid, and thus, the liquid flows in the supply path to reduce the pressure. Such pressure fluctuations due to liquid flow and resulting fluctuations of the discharge state of the discharge mechanism portions cannot be prevented through alleviation of direct propagation of a pressure wave.

In the liquid discharge head disclosed in Japanese Patent Application Laid-Open No. 2006-123397, a large number of pressure chambers connected to one common liquid chamber are grouped into four pressure chamber arrays, and pressure generating units of pressure chambers that belong to one pressure chamber array are driven at a timing different from that of pressure generating units of pressure chambers that belong to another adjacent pressure chamber array. The pressure generating units of the large number of pressure chambers are grouped into four groups when driven, and thus, the peak value of drive power is lowered, and pressure fluctuations accompanying the drive can be alleviated. However, pressure generating units of a plurality of pressure chambers that are connected to the same common liquid chamber and that belong to the same pressure chamber array are driven at the same time, and thus, occurrence of the interference cannot be avoided.

Further, in order to connect a plurality of pressure chambers that belong to one pressure chamber array to one common liquid chamber, as illustrated in FIGS. 3A to 3C of Japanese Patent Application Laid-Open No. 2006-123397, the common liquid chamber is required to be provided between the pressure chambers and the discharge ports in the height direction. The reason is that, if a long common liquid chamber to which the plurality of pressure chambers can be connected is provided on a side opposite to the discharge ports, a support substrate for maintaining an entire shape is divided and a necessary strength cannot be maintained. If the common liquid chamber is provided between the pressure chambers and the discharge ports, it is inevitable that the common liquid chamber is elongated in a horizontal direction and is in a narrow shape. When a large number of pressure chambers are connected to the narrow common liquid chamber and pressure generating units of the large number of pressure chambers are driven, occurrence of the interference due to liquid flow cannot be avoided, and the discharge state fluctuates.

SUMMARY OF THE INVENTION

In order to achieve the object described above, according to an embodiment of the present invention, there is provided a liquid discharge apparatus, including: a liquid discharge head including: a substrate; a plurality of pressure chambers two-dimensionally provided on a first surface side of the substrate; a discharge port, a pressure generating unit configured to discharge liquid through the discharge port, and a flow path connected to the pressure chamber which are all provided correspondingly to each of the plurality of pressure chambers; a common liquid chamber provided on a second surface side of the substrate; and a plurality of supply paths provided between adjacent ones of the plurality of pressure chambers and connected to the common liquid chamber; a moving unit configured to relatively move the liquid discharge head and a recording object; and a driving unit configured to drive the pressure generating unit, in which flow paths respectively corresponding to the plurality of pressure chambers adjacent to the supply paths are connected to the supply paths, and in which the driving unit outputs drive signals to pressure generating units respectively corresponding to the plurality of pressure chambers connected to the supply paths at different timings.

In order to achieve the object described above, according to an embodiment of the present invention, there is provided a liquid discharge head, including: a substrate; a plurality of pressure chambers two-dimensionally provided on a first surface side of the substrate; a discharge port, a pressure generating unit configured to discharge liquid through the discharge port, and a first flow path and a second flow path each connected to the pressure chambers which are provided correspondingly to each of the plurality of pressure chambers; a first common liquid chamber and a second common liquid chamber that are provided on a second surface side of the substrate; a first supply path provided between adjacent ones of the plurality of pressure chambers and connected to the first common liquid chamber; and a second supply path provided between adjacent ones of the plurality of pressure chambers and connected to the second common liquid chamber, in which the first flow path corresponding to each of the plurality of pressure chambers adjacent to the first supply path is connected to the first supply path, in which the second flow path corresponding to each of the plurality of pressure chambers adjacent to the second supply path is connected to the second supply path, and in which a pressure chamber connected to each of the plurality of pressure chambers via the first supply path is different from a pressure chamber connected to each of the plurality of pressure chambers via the second supply path.

According to the embodiment of the present invention, the pressure generating units of the plurality of pressure chambers connected to one supply path are driven at different timings. The pressure generating units of the plurality of pressure chambers connected to the one supply path are not driven at the same time, and thus, liquid flows from the flow paths connected to the respective pressure chambers in a forward direction and in a reverse direction at different timings. As a result, interference among discharge mechanism portions can be reduced to inhibit fluctuations of the discharge state of the discharge mechanism portions.

Further, according to the embodiment of the present invention, a pressure chamber connected to each of the pressure chambers via the first supply path is different from a pressure chamber connected to each of the pressure chambers via the second supply path. Therefore, interference among the discharge mechanism portions can be dispersed, and thus, fluctuations of the discharge state of the discharge mechanism portions can be inhibited.

Further features of the present invention will become apparent from the following description of exemplary embodiments with reference to the attached drawings.

DESCRIPTION OF THE EMBODIMENTS

Embodiments for carrying out the present invention are described in the following with reference to the attached drawings.

First Embodiment

Figure 1:
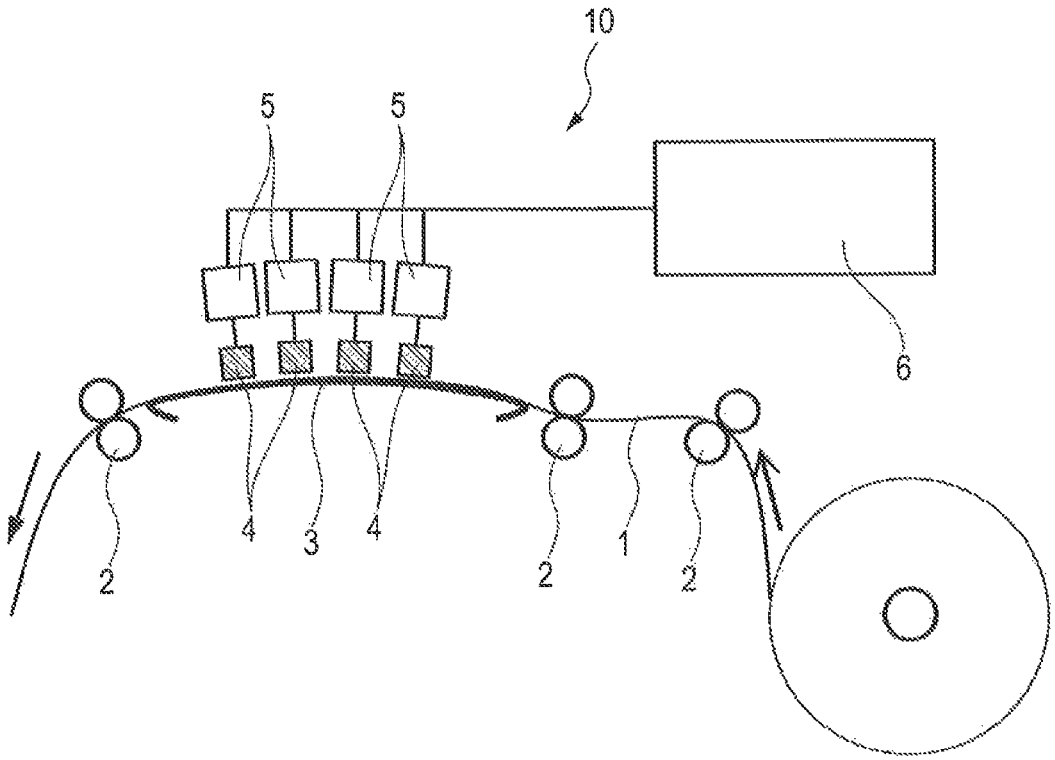
FIG. 1 is an illustration of a structure of a liquid discharge apparatus according to a first embodiment of the present invention.

FIG. 1 is an illustration of a structure of a liquid discharge apparatus 10 according to a first embodiment of the present invention.

Recording paper 1 as a recording object is conveyed to a direction indicated by the arrow by paper feed rollers 2 as a moving unit configured to convey the recording paper 1. Four liquid discharge head units 4 are provided so as to be opposed to the recording paper 1 that is conveyed onto a platen 3. The liquid discharge head units 4 respectively discharge liquid (ink) of, for example, cyan, magenta, yellow, and black to conduct recording on the recording paper 1. A driving unit 5 configured to electrically drive a pressure generating unit configured to generate a pressure for discharging liquid is connected to each of the liquid discharge head units 4. The driving unit 5 outputs a drive signal for the pressure generating unit based on an image signal sent from a controller 6 or the like.

Figure 2:
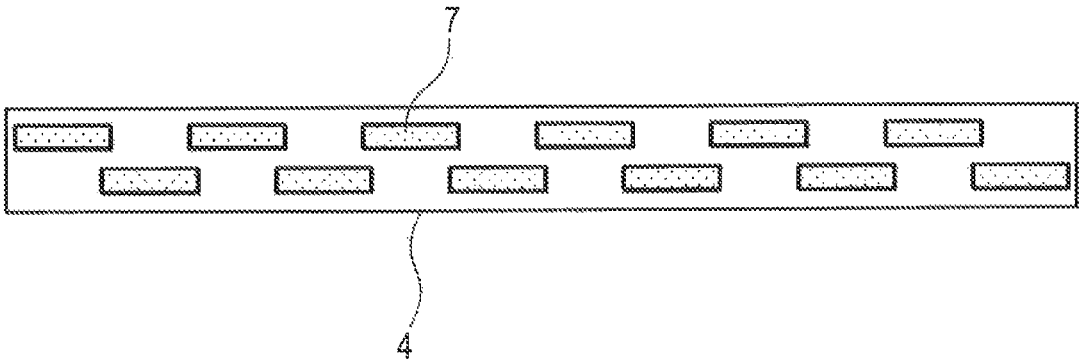
FIG. 2 is an illustration of a liquid discharge head unit illustrated in FIG. 1, seen from a discharge port surface side.

FIG. 2 is an illustration of the liquid discharge head unit 4 seen from a discharge port surface side.

As illustrated in FIG. 2, a plurality of liquid discharge heads 7 are arranged in the liquid discharge head unit 4 in a staggered manner. 2,000 discharge mechanism portions are provided in each of the liquid discharge heads 7. The liquid discharge head units 4 are capable of conducting recording of 1,200 dots per inch (dpi).

Note that, a plane in which discharge ports are formed is hereinafter referred to as an X-Y plane and a direction in which the liquid discharge heads 7 and the recording paper 1 are relatively moved is hereinafter referred to as a Y direction.

Figure 3A:
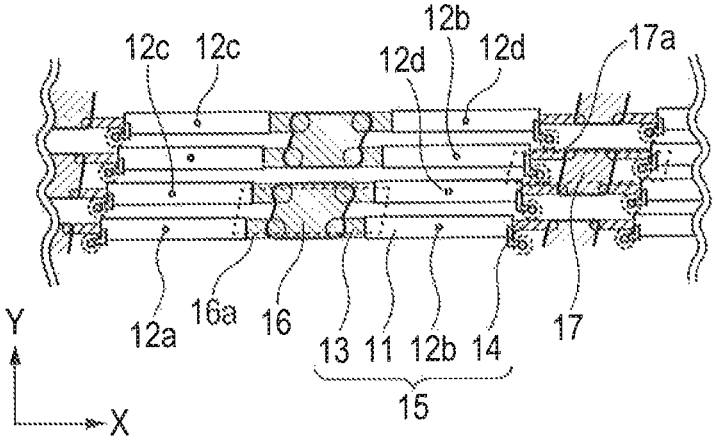
FIGS. 3A, 3B and 3C are illustrations of main structures of a liquid discharge head illustrated in FIG. 2.
Figure 3B:
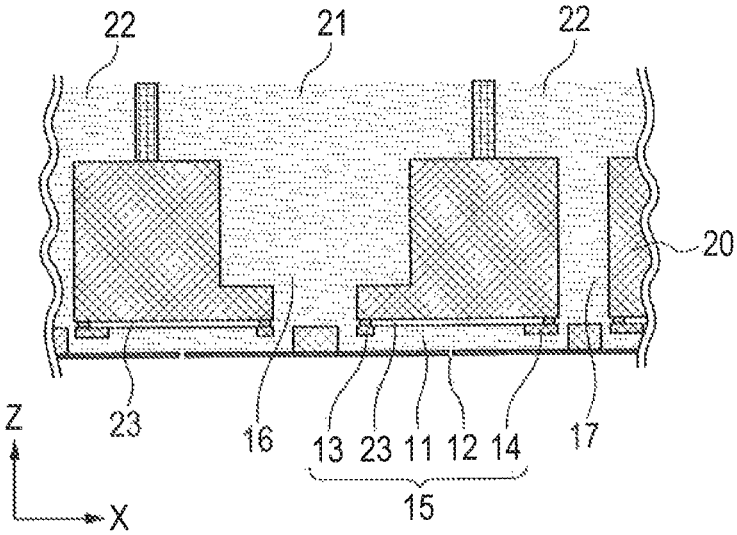
Figure 3C:
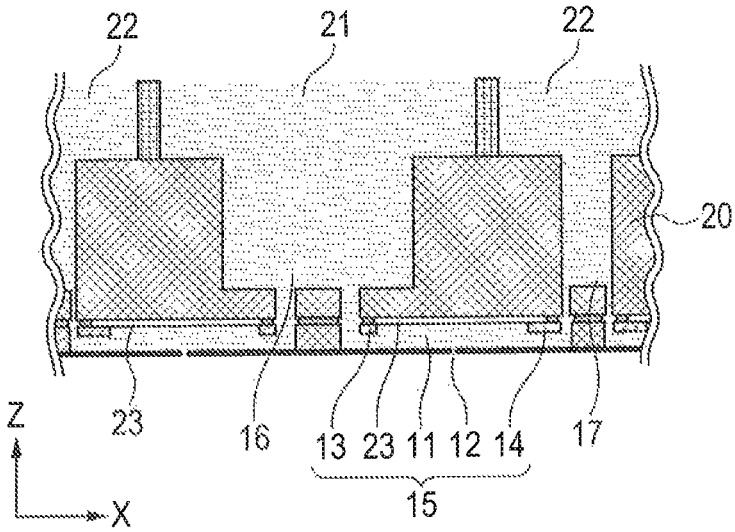

FIGS. 3A to 3C are illustrations of main structures of the liquid discharge head 7. FIG. 3A is a perspective view of the liquid discharge head 7 seen from a front, and FIGS. 3B and 3C are sectional views of the liquid discharge head 7. Note that, there are cases in which the viscosity of liquid is increased to cause defective discharge when the discharge is halted or air bubbles accumulate in a pressure chamber to cause defective discharge in continuous discharge. According to this embodiment, a case is described in which, in order to solve these problems, the liquid discharge head 7 has a structure of circulating liquid in the pressure chamber.

As illustrated in FIG. 3A, the liquid discharge head 7 includes a plurality of pressure chambers 11 that are two-dimensionally arranged, discharge ports 12 (12*a* to 12*d*) provided correspondingly to the respective pressure chambers 11, an inflow flow path 13 as a first flow path, and an outflow flow path 14 as a second flow path. The pressure chamber 11, the corresponding discharge ports 12 provided in the pressure chamber 11, the flow paths (inflow flow path 13 and outflow flow path 14), and a pressure generating unit (not shown in FIG. 3A) form a discharge mechanism portion 15.

With reference to FIG. 3A, four rows of the discharge mechanism portions 15 are arranged in the Y direction. As a whole, for example, forty rows of the discharge mechanism portions 15 are arranged in the Y direction.

As illustrated in FIG. 3A, the inflow flow path is connected to an inflow supply path 16 as a first supply path. The outflow flow path 14 is connected to an outflow supply path 17 as a second supply path. More specifically, the inflow flow path 13 that is located at each vertex of a quadrangle 16*a* having a center that corresponds to a center of the inflow supply path 16 and that corresponds to each of the four pressure chambers 11 adjacent to the inflow supply path 16 is connected to the inflow supply path 16. Further, the outflow flow path 14 that is located at each vertex of a quadrangle 17*a* having a center that corresponds to a center of the outflow supply path 17 and that corresponds to each of the four pressure chambers 11 adjacent to the outflow supply path 17 is connected to the outflow supply path 17.

Further, as illustrated in FIG. 3A, with regard to each of the pressure chambers 11, the other three pressure chambers 11 connected via the inflow supply paths 16 and the other three pressure chambers 11 connected via the outflow supply paths 17 are all different.

The structure described above can disperse an influence of interference among the discharge mechanism portions 15, that is, so-called crosstalk, to inhibit fluctuations in a discharge state. As a result, quality of the recording can be inhibited from being lowered. Note that, in this embodiment, a case is described in which the number (p) of pressure chambers connected to one supply path is four is described as an example, but the present invention is not limited thereto.

Here, an effect of connecting four pressure chambers 11 to one inflow supply path 16 is described. Description is made here with regard to the inflow supply path 16, but the same can be said with regard to the outflow supply path 17.

In the case illustrated in FIG. 3A, all of the inflow flow paths 13 respectively corresponding to four pressure chambers 11 that are connected to one inflow supply path 16 have the same length and the same cross-sectional area, and are respectively connected to corner portions of one inflow supply path 16 in the shape of a rounded quadrangle. Therefore, the four inflow flow paths 13 have substantially the same hydrodynamic characteristics, and there is almost no difference in discharge amount and the like among the discharge mechanism portions 15 respectively corresponding to the inflow flow paths 13.

If the inflow supply path 16 is elongated in the vertical direction (Y direction), it is also possible to connect six or more pressure chambers 11 thereto. However, in this case, hydrodynamic characteristics of a discharge mechanism portion 15 that is connected to the inflow supply path 16 around a vertex of the inflow supply path 16 and hydrodynamic characteristics of a discharge mechanism portion 15 that is connected to the inflow supply path 16 around a midpoint of the inflow supply path 16 cannot be set uniform.

If the inflow supply path 16 is provided in the shape of a circle, no difference is caused by whether the connection is made around a vertex or not. However, such a structure necessitates nonuniform lengths of the inflow flow paths 13 or nonuniform distances between the connection positions and inner wall surfaces of the inflow flow paths 13, and thus, the hydrodynamic characteristics cannot be set uniform.

Note that, the hydrodynamic characteristics are characteristics such as inertia and viscous resistance of fluid. These characteristics vary depending on a flow velocity and a change in flow velocity over time, and thus, it is generally difficult to uniformize hydrodynamic characteristics of flow paths having different shapes.

If only one or two pressure chambers 11 are connected to one inflow supply path 16, the hydrodynamic characteristics can be uniformized. However, when only one or two pressure chambers 11 are connected to one inflow supply path 16, compared with the case in which four pressure chambers 11 are connected to one inflow supply path 16, it is necessary to form a larger number of smaller inflow supply paths 16. Therefore, the flow resistance in the inflow supply path 16 increases, and problems such as difficulty in driving at high frequency arise.

Therefore, the structure in which four pressure chambers 11 are connected to one inflow supply path 16 is a particularly excellent structure from the viewpoint of two-dimensionally arranging a large number of pressure chambers (regularly in the X direction and in the Y direction) and arranging the discharge mechanism portions 15 at high density.

With reference to FIG. 3B, the inflow supply path 16 and the outflow supply path 17 pierce in a direction perpendicular to a substrate 20 (Z direction). The inflow supply path 16 pierces in two stages, and becomes larger at a portion communicating with an inflow common liquid chamber 21 as a first common liquid chamber. This can reduce the flow resistance. The outflow supply path 17 communicates with an outflow common liquid chamber 22 as a second common liquid chamber.

The inflow flow path 13 bends in the direction perpendicular to the substrate 20 to be connected to the inflow supply path 16. The outflow flow path 14 bends in the direction perpendicular to the substrate 20 to be connected to the outflow supply path 17.

Note that, as illustrated in FIG. 3C, the inflow supply path 16 and the outflow supply path 17 may not pierce the substrate 20, and the inflow flow path 13 and the outflow flow path 14 may reach an inside of the substrate 20 to be connected to the inflow supply path 16 and the outflow supply path 17, respectively.

The inflow common liquid chamber 21 and the outflow common liquid chamber 22 are provided in a second surface of the substrate 20 on a side opposite to a first surface in which the pressure chamber 11 is arranged. The inflow common liquid chamber 21 is connected to the inflow supply path 16, and the outflow common liquid chamber 22 is connected to the outflow supply path 17. Liquid in the inflow common liquid chamber 21 is kept under a small negative pressure of about −300 Pa by a liquid supply device (not shown). Liquid in the outflow common liquid chamber 22 is kept under a negative pressure that is further lower by several hundreds of pascals. This can cause liquid to flow slowly in the pressure chamber 11 during standing-by to prevent the liquid from increasing the viscosity thereof due to vaporization through the discharge ports 11 and the like.

Note that, it is also possible to use both the inflow common liquid chamber 21 and the outflow common liquid chamber 22 as common liquid chambers without discrimination therebetween through keeping the inflow common liquid chamber 21 and the outflow common liquid chamber 22 under approximately the same pressure.

A bending piezoelectric element 23 as the pressure generating unit is provided in each of the pressure chambers 11. The piezoelectric element 23 is driven through a drive waveform signal (drive signal) that is output from the driving unit 5.

Next, the order of drive of the discharge mechanism portion 15 (piezoelectric element 23) by the driving unit 5 is described. Description is made below with regard to a case as an example in which, as illustrated in FIG. 3A, pressure chambers 11 respectively corresponding to the discharge ports 12*a* to 12*d* are connected to one inflow supply path 16.

The driving unit 5 drives the piezoelectric elements 23 in the pressure chambers 11 corresponding to the discharge ports 12 so that the piezoelectric elements 23 corresponding to the discharge ports 12*a*, 12*b*, 12*c*, and 12*d* are driven in this order.

Figure 4:
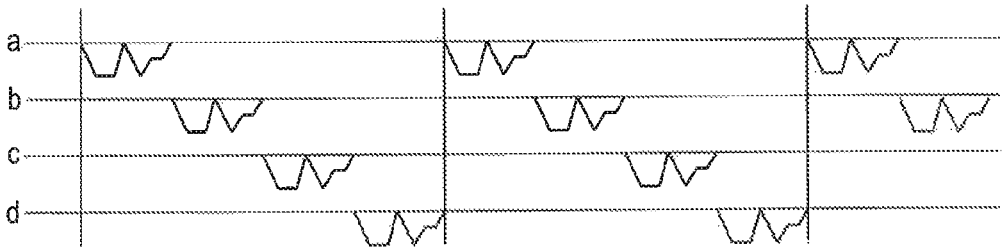
FIG. 4 is a graph for showing exemplary drive waveform signals that are output from a driving unit illustrated in FIG. 1.

FIG. 4 is a graph for showing exemplary drive waveform signals that are output from the driving unit 5. In FIG. 4, a case in which the drive waveform signals are of negative voltages is shown. Further, with reference to FIG. 4, signals a, b, c, and d are drive waveform signals for the piezoelectric elements 23 provided in the pressure chambers 11 corresponding to the discharge ports 12*a*, 12*b*, 12*c*, and 12*d*, respectively. Note that, it is apparent that, depending on an image to be recorded, there are a case in which the piezoelectric elements are actually driven and a case in which no signal is output and the piezoelectric elements are not driven.

As shown in FIG. 4, the driving unit 5 drives the piezoelectric elements 23 of the plurality of pressure chambers 11 connected to one inflow supply path 16 at different timings (drive signals are output to the respective piezoelectric elements 23 at different timings). Therefore, the piezoelectric elements 23 in the plurality of pressure chambers 11 connected to one inflow supply path are not driven at the same time. Therefore, an influence on a recorded image of a change in the number of the discharge mechanism portions 15 that are driven at the same time can be reduced.

Next, arrangement of the discharge ports 12 is described. In the description below, the size of one pixel when a record is produced at 1,200 dpi, that is, 21.167 μm, is defined as a constant A.

The discharge port 12*b* illustrated in FIG. 3A is at a position that is offset from the discharge port 12*a* on a left side thereof by 40 A in the X direction and by 0.25 A in the Y direction. The discharge port 12*c* is at a position that is offset from the discharge port 12*a* downward adjacent thereto in the figure by A in the X direction and by A(5+0.5) in the Y direction. The discharge port 12*b* is at a position that is offset from the discharge port 12*a* on the lower left side of the discharge port 12*b* by 41 A in the X direction and by A(5+0.75) in the Y direction.

When the position of the one discharge port (12*a*) is set as a coordinate origin and n and m are integers, the positions of the other discharge ports 12*b*, 12*c*, and 12*d* are defined as follows. The positions of the other discharge ports 12 in the X direction are defined as approximately An, and the positions of the other discharge ports 12 in the Y direction are defined as approximately A(m+b) ($0 \leq b < 1$). In this case, all values of b for the discharge ports 12 respectively corresponding to the pressure chambers 11 connected to one inflow supply path 16 are different from one another.

As described above, according to this embodiment, the positions of the discharge ports 12 are finely adjusted with an accuracy of pitches of recorded pixels or less. Therefore, an impact position misalignment due to the different timings of the drive can be prevented.

When the recording paper 1 is moved in the Y direction relative to the liquid discharge heads 7 to conduct recording thereon, the driving unit 5 drives the piezoelectric elements 23 corresponding to the discharge ports 12*a*, 12*b*, 12*c*, and 12*d* in this order at intervals that are approximately ¼ of a period of time necessary for the recording paper 1 to travel the distance A. Specifically, the driving unit 5 drives the piezoelectric elements 23 with a timing difference defined as $\Delta t = \Delta \times \Delta b / v$, where v is the relative moving speed of the recording paper 1, Δb is an error in b among the plurality of discharge ports, and Δt is the timing difference of driving of the piezoelectric elements 23 corresponding to the respective discharge ports. This enables recording with accuracy without impact error and the like due to driving of the plurality of discharge mechanism portions 15 in a time division manner.

Further, according to this embodiment, both of the distance between the discharge port 12*a* and the discharge port 12*c* that are adjacent to each other in the Y direction and the distance between the discharge port 12*b* and the discharge port 12*d* that are adjacent to each other in the Y direction are 5.5 A, and the discharge mechanism portions 15 are regularly arranged without unnecessary spaces. Therefore, when the discharge mechanism portions 15 adjacent to each other in the Y direction are driven in succession, an impact position misalignment may be caused due to the different timings of the driving. Therefore, the driving unit 5 drives, alternately in the X direction, the piezoelectric elements corresponding to an even number of pressure chambers 11 that sandwich the inflow supply path 16 in the X direction. This can prevent the impact position misalignment due to the different timings of the driving.

As described above, according to this embodiment, the liquid discharge apparatus 10 includes the driving unit 5 and the liquid discharge head 7 in which the flow paths (13 and 14) are connected to the supply paths (16 and 17) connected to common liquid chambers, the flow paths (13 and 14) respectively corresponding to the plurality of pressure chambers 11 adjacent to the supply paths (16 and 17). The driving unit 5 outputs drive signals to the piezoelectric elements 23 respectively corresponding to the plurality of pressure chambers 11 that are connected to the same supply path at different timings.

Connecting a plurality of discharge mechanism portions to one supply path can reduce the number of supply paths. In general, a flow resistance of fluid is inversely proportional to a square of a cross section of the flow path. Therefore, through reduction of the number of supply paths corresponding to a large number of discharge mechanism portions, the flow resistance can be reduced without increasing the total cross section of the supply paths relative to the substrate. However, if the number of discharge mechanism portions connected to one supply path is excessively large to increase the total cross section of the supply paths, such problems arise that a necessary strength of the substrate cannot be maintained because the substrate is divided by the supply paths. The number of discharge mechanism portions that can be connected to one supply path depends on specific design of the discharge mechanism portions, but there is a design limitation. As a result, pressure chambers of a plurality of discharge mechanism portions are connected to a supply path having a flow resistance that is not sufficiently low. In view of this, in the present invention, pressure generating units corresponding to a plurality of pressure chambers connected to one supply path are driven at different timings. Pressure generating units in a plurality of pressure chambers connected to one supply path are not driven at the same time, and thus, liquid flows from flow paths connected to the respective pressure chambers in a forward direction and in a reverse direction at different timings. As a result, an influence of the flow resistance in the supply paths can be reduced and interference among the discharge mechanism portions can be reduced to inhibit fluctuations of the discharge state.

Second Embodiment

In a second embodiment of the present invention, structures of the liquid discharge apparatus, the liquid discharge head unit, and the liquid discharge head are similar to those in the first embodiment. However, this embodiment is different from the first embodiment in the order of driving of the discharge mechanism portions.

Figure 5:
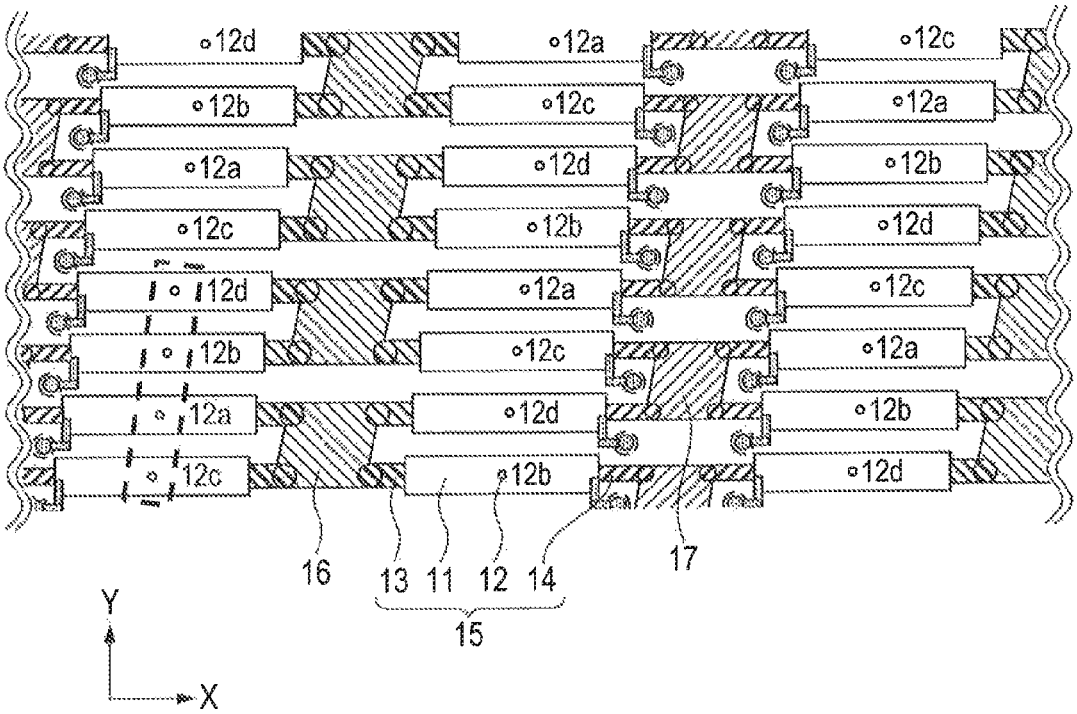
FIG. 5 is an illustration of a main structure of a liquid discharge head according to a second embodiment of the present invention.
Figure 6:
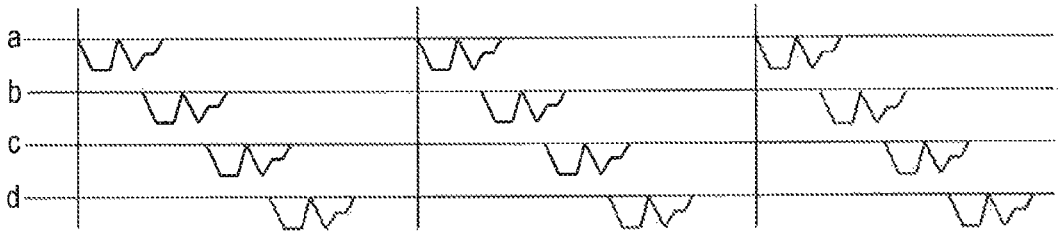
FIG. 6 is a graph for showing a method of driving a discharge mechanism portion according to the second embodiment of the present invention.

FIG. 5 is an illustration of a main portion of the liquid discharge head 7 according to this embodiment. FIG. 6 is a graph for showing drive signals for driving the piezoelectric elements 23 corresponding to the discharge ports 12*a* to 12*d* illustrated in FIG. 5.

When FIG. 5 is compared with FIG. 3A, arrangement of the discharge ports 12 (12*a* to 12*d*) of the respective four discharge mechanism portions 15 connected to one supply path (inflow supply path 16 or outflow supply path 17) is different. Specifically, with reference to FIG. 3A, the straight line connecting the discharge port 12*a* and the discharge port 12*b* and the straight line connecting the discharge port 12*c* and the discharge port 12*d* are substantially in parallel with each other. On the other hand, with reference to FIG. 5, the straight line connecting the discharge port 12*a* and the discharge port 12*b* and the straight line connecting the discharge port 12*c* and the discharge port 12*d* intersect each other.

FIG. 6 is a graph for showing drive signals that are output by the driving unit 5 to the piezoelectric elements 23 corresponding to the discharge ports 12*a* to 12*d*. The signals a, b, c, and d are drive signals that are output to the piezoelectric elements 23 corresponding to the discharge ports 12*a*, 12*b*, 12*c*, and 12*d*, respectively.

As shown in FIG. 6, according to this embodiment, the driving unit 5 outputs drive signals to piezoelectric elements 23 of four pressure chambers 11 connected to one supply path (inflow supply path 16 or outflow supply path 17) at different timings. Therefore, the piezoelectric elements 23 of the four discharge mechanism portions 15 connected to one inflow supply path 16 are not driven at the same time. Further, the piezoelectric elements 23 of the four discharge mechanism portions 15 connected to one outflow supply path 17 are not driven at the same time. Therefore, an influence on a recorded image of a change in the number of the discharge mechanism portions 15 that are driven at the same time can be reduced.

In this embodiment, all of the piezoelectric elements 23 corresponding to four discharge ports 12 (see the portion surrounded by the dotted line of FIG. 5) arranged in succession in the Y direction are also driven at different timings.

After the driving, the pressure or the flow of liquid causes vibration due to residual vibrations or interference among the pressure chambers. When a plurality of discharge mechanism portions are driven in a time division manner, if intervals between respective timings of starting the driving can be set completely the same, difference in the discharge state depending on the order of driving is not caused.

In general, in a liquid discharge apparatus, respective timings of starting the driving are set in synchronization with the speed of a paper feeding by paper feed rollers. This enables an image to be recorded without deformation even when the paper feeding speed has an error. However, if the paper feeding speed has an error, the driving cycle fluctuates. In particular, if, before output of a last drive waveform in a drive cycle is completed, the subsequent drive cycle starts, a malfunction occurs. Therefore, it is actually difficult to completely equalize the intervals between respective timings of starting the driving in a time division manner, and a sufficient length of time is secured after the last drive waveform in the drive cycle is completed and before the subsequent drive cycle starts. Therefore, depending on the order of driving, the pressure or the flow of liquid generated when the discharge mechanism portions are driven differs to cause difference in the discharge states.

The difference in the discharge state described above is that of such an extent that it cannot be visually recognized through simple comparison between dots. However, when drive signals, which are output to the piezoelectric elements 23 corresponding to the discharge ports 12 for forming dots in a certain region on the recording paper 1, are extremely imbalanced, density unevenness may appear in the recorded image. For example, when piezoelectric elements 23 corresponding to a certain row of discharge ports 12 arranged in the Y direction are driven only by the signals a and b and piezoelectric elements 23 corresponding to the next row of discharge ports 12 are driven only by the signals c and d, density unevenness may appear in the recorded image. In this embodiment, all of the piezoelectric elements 23 corresponding to four discharge ports 12 arranged in succession in a row of the discharge ports 12 arranged in the Y direction are driven at different timings, and thus, the drive signals are balanced. Therefore, density unevenness described above can be prevented from appearing.

Figure 7:
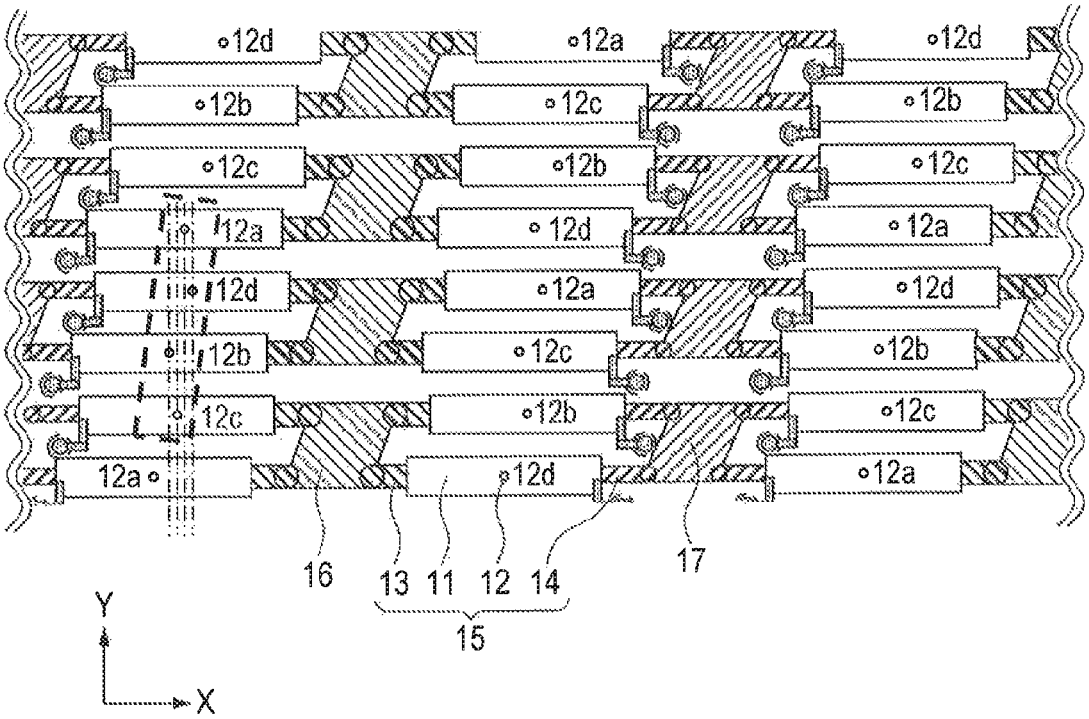
FIG. 7 is an illustration of another main structure of the liquid discharge head according to the second embodiment of the present invention.

FIG. 7 is an illustration of another main structure of the liquid discharge head 7 according to the second embodiment of the present invention. With reference to FIG. 7, when the discharge ports 12*a* to 12*d* arranged in the Y direction are projected onto the X axis, projected points of the discharge ports 12 of two pressure chambers 11 connected to one inflow supply path 16 (discharge port 12*b* and discharge port 12*d* in a portion surrounded by the dotted line) are apart from each other by a distance corresponding to three pixels. Between these two points, projected points of the discharge ports 12 of pressure chambers 11 connected to adjacent two inflow supply paths 16 (projections of the discharge port 12*a* and the discharge port 12*c* in the portion surrounded by the dotted line) are positioned. Specifically, when the discharge ports 12*a* to 12*d* are projected onto the X axis, points respectively corresponding to the discharge ports 12*a* to 12*d* are positioned on the X axis in succession.

As described above, with reference to FIG. 7, the discharge ports 12 that are arranged in succession in the Y direction are arranged in an interlaced manner. Also in the liquid discharge head illustrated in FIG. 7, by driving the piezoelectric elements 23 in the order of the discharge ports 12*a*, 12*c*, 12*d*, and 12*d* corresponding thereto, a similar effect can be obtained.

Note that, also in the liquid discharge head 7 according to this embodiment, the discharge ports 12 are arranged similarly to the case of the first embodiment. That is, when one discharge port is set as a coordinate origin and n and m are integers, the positions of the other discharge ports 12 in the X direction are defined as approximately An, and the positions of the other discharge ports 12 in the Y direction are defined as approximately A(m+b) ($0 \leq b < 1$). In this case, all values of b for the discharge ports 12 respectively corresponding to the pressure chambers 11 connected to one inflow supply path 16 are different from one another. Further, at least p (four) discharge ports 12 adjacent to each other in the Y direction (see the discharge ports 12*a* to 12*d* surrounded by the dotted line) are arranged so as to be in succession when projected onto the X axis, and the respective discharge ports 12 have different values of b.

Further, also in the liquid discharge head 7 according to this embodiment, similarly to the case of the first embodiment, the piezoelectric elements 23 are driven with a timing difference defined as $\Delta t = A \times \Delta b / v$. This enables recording with accuracy without impact errors and the like due to driving of the plurality of discharge mechanism portions 15 in a time division manner.

Third Embodiment

Figure 8:
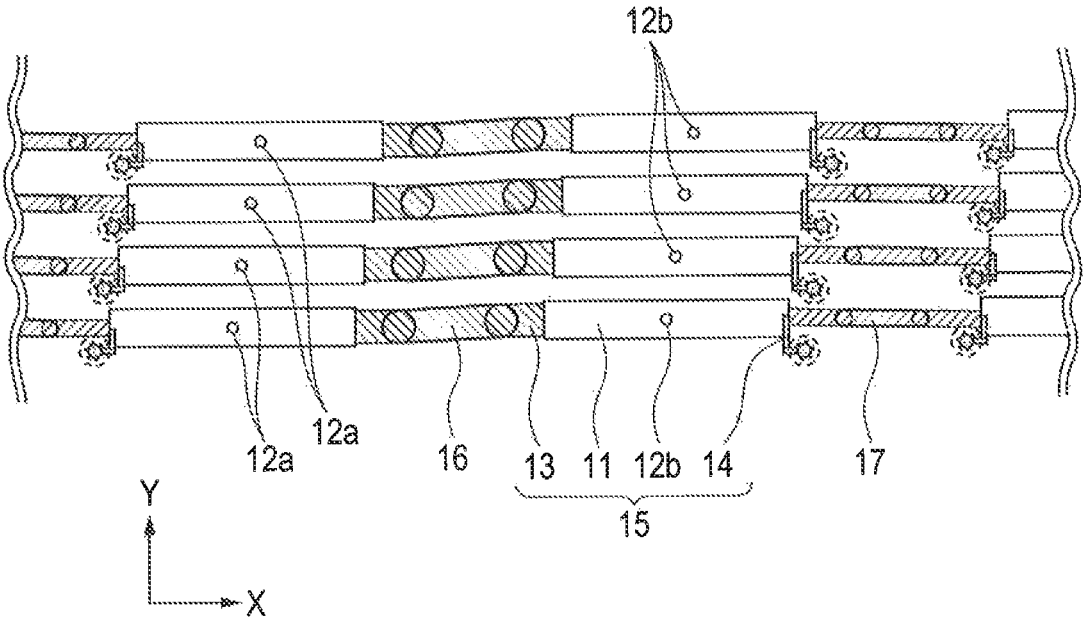
FIG. 8 is an illustration of a main structure of a liquid discharge head according to a third embodiment of the present invention.

FIG. 8 is an illustration of a main structure of the liquid discharge head 7 according to a third embodiment of the present invention.

In this embodiment, as illustrated in FIG. 8, two pressure chambers 11 (pressure chamber 11 corresponding to the discharge port 12*a* and pressure chamber 11 corresponding to the discharge port 12*b*) are connected to one inflow supply path 16 via the inflow flow paths 13. Further, two pressure chambers 11 (pressure chamber 11 corresponding to the discharge port 12*a* and pressure chamber 11 corresponding to the discharge port 12*b*) are connected to one outflow supply path 17 via the outflow flow paths 14. Further, each of the pressure chambers 11 is connected to different pressure chambers 11 via the inflow supply path 16 and via the outflow supply path 17.

The driving unit 5 alternately drives the piezoelectric element 23 corresponding to the discharge port 12*a* and the piezoelectric element 23 corresponding to the discharge port 12*b* at substantially uniform intervals. Therefore, the discharge mechanism portions 15 are driven every time the recording paper 1 travels the distance A.

In this embodiment, the distance in the Y direction between two discharge ports 12*a* that are adjacent to each other in the Y direction is 6 A, and the distance therebetween in the X direction is A. Further, the distance in the X direction between the discharge port 12*a* and the discharge port 12*b* that are connected to one inflow supply path 16 is 40 A, and the distance therebetween in the Y direction is 0.5 A. Further, similarly to the case of the inflow supply path 16, two pressure chambers 11 (pressure chamber 11 corresponding to the discharge port 12*a* and pressure chamber 11 corresponding to the discharge port 12*b*) are connected to one outflow supply path 17.

The structure described above enables recording with accuracy without impact errors and the like due to driving of the plurality of discharge mechanism portions 15 in a time division manner.

Also in this embodiment, the driving unit 5 drives the piezoelectric elements 23 of the plurality of pressure chambers 11 connected to one supply path at different timings. The piezoelectric elements 23 corresponding to the plurality of pressure chambers 11 connected to one supply path are not driven at the same time, and thus, liquid flows from flow paths connected to the respective pressure chambers in a forward direction and in a reverse direction at different timings. As a result, an influence of the flow resistance in the supply paths can be reduced and interference among the discharge mechanism portions 15 can be reduced. Thus, fluctuations of the discharge state can be inhibited. Further, each of the pressure chambers 11 is connected to different pressure chambers 11 via the inflow supply path 16 and via the outflow supply path 17. Therefore, an adverse influence of crosstalk can be sufficiently inhibited.

Fourth Embodiment

In a fourth embodiment of the present invention, structures of the liquid discharge apparatus and the liquid discharge head unit are similar to those in the first embodiment. Further, the structure of the liquid discharge head is similar to that in the third embodiment. However, this embodiment is different from the third embodiment in the order of driving of the discharge mechanism portions.

Figure 9:
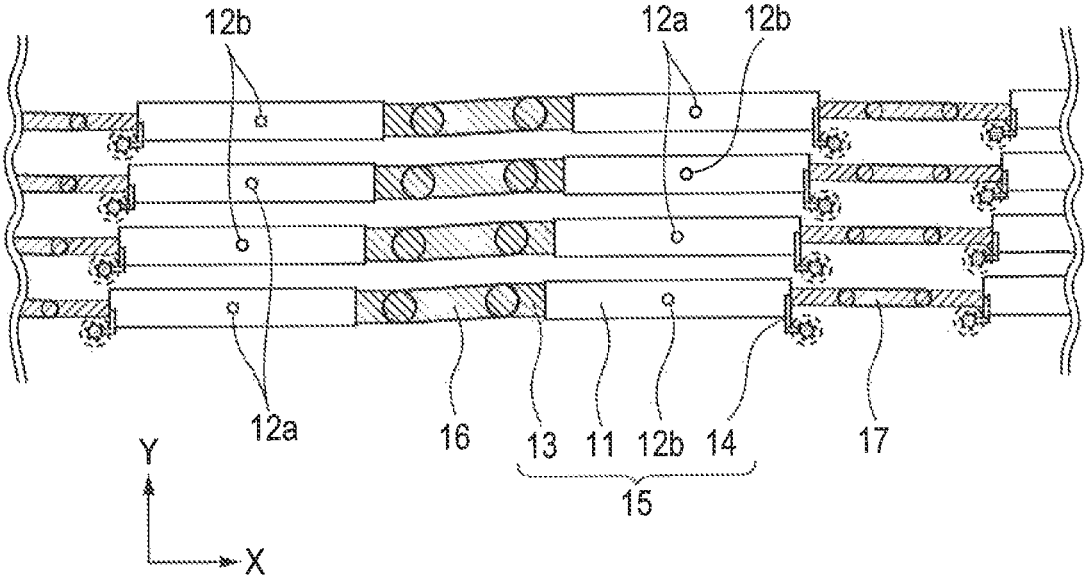
FIG. 9 is an illustration of a main structure of a liquid discharge head according to a fourth embodiment of the present invention.

FIG. 9 is an illustration of a main structure of the liquid discharge head 7 according to the fourth embodiment of the present invention. The liquid discharge head 7 according to this embodiment has a structure similar to that of the liquid discharge head 7 according to the third embodiment.

The driving unit 5 alternately drives the piezoelectric elements 23 corresponding to the discharge ports 12 adjacent to each other in a row of the discharge ports 12 arranged in the Y direction. Such a structure can inhibit density unevenness that appears in a recorded image due to difference in discharge state caused by the order of driving.

Fifth Embodiment

Figure 10:
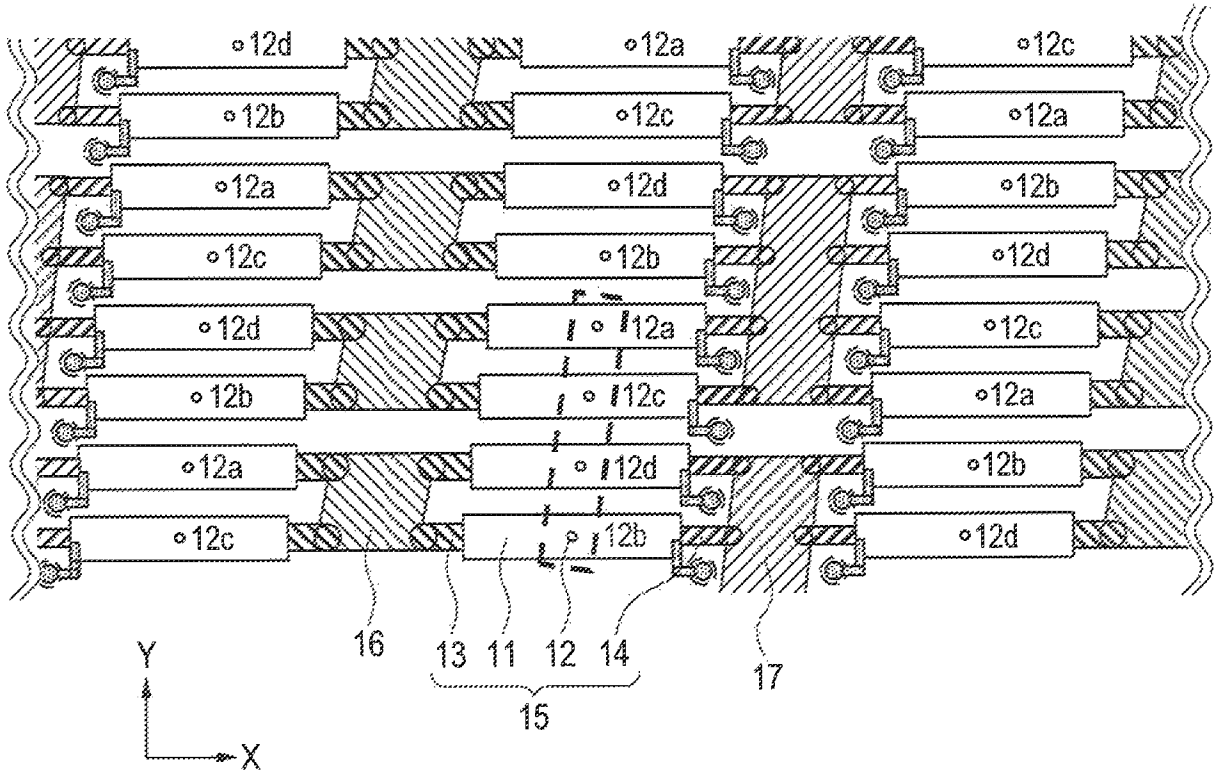
FIG. 10 is an illustration of a main structure of a liquid discharge head according to a fifth embodiment of the present invention.

FIG. 10 is an illustration of a main structure of the liquid discharge head 7 according to a fifth embodiment of the present invention.

In this embodiment, as illustrated in FIG. 10, four pressure chambers 11 are connected to one inflow supply path 16 via the inflow flow paths 13. Further, eight pressure chambers 11 are connected to one outflow supply path 17 via the outflow flow paths 14. Note that, in this embodiment, a case is described in which the number p of the pressure chambers 11 connected to one inflow supply path 16 is four, and the number q of the pressure chambers 11 connected to one outflow supply path 17 is eight, but the present invention is not limited thereto.

In general, the inflow flow path 13 is designed to have a relatively low flow resistance in order to obtain a sufficient refill speed. Therefore, interference due to pressure fluctuations caused when the discharge mechanism portion 15 is driven has a considerable influence. Therefore, according to this embodiment, the number of pressure chambers 11 connected to one inflow supply path 16 is smaller than the number of pressure chambers 11 connected to one outflow supply path 17.

The driving unit 5 has r or more kinds of output timings of the drive signal in one discharge cycle, where r is a value of the smaller one of p and q. Specifically, the driving unit 5 can divide the plurality of discharge mechanism portions 15 by r and can drive the discharge mechanism portions 15 in a time division manner. In this embodiment, p=r. Therefore, the driving unit 5 can drive the piezoelectric elements 23 of p pressure chambers 11 connected to one inflow supply path 16 at different timings. In the following, a case is described in which the driving unit 5 divides the plurality of discharge mechanism portions 15 by four, which is the same as the number of the pressure chambers 11 connected to one inflow supply path 16, and drives the discharge mechanism portions 15 in a time division manner.

The driving unit 5 divides, by four, four discharge mechanism portions 15 including the pressure chambers 11 connected to one inflow supply path 16 and four discharge mechanism portions 15 including the pressure chambers 11 connected to one outflow supply path 17, and drives each of the discharge mechanism portions 15 in a time division manner. Therefore, the driving unit 5 drives the piezoelectric elements 23 corresponding to four pressure chambers 11 connected to one inflow supply path 16 at different timings. In this case, every two of the pressure chambers 11 corresponding to the discharge ports 12*a* to 12*d* are connected to the outflow supply path 17. Therefore, the piezoelectric elements 23 corresponding to two pressure chambers 11 among the plurality of pressure chambers 11 connected to one outflow supply path 17 are driven at the same time. However, the outflow flow path 14 has a relatively high flow resistance, and interference among the discharge mechanism portions 15 is less liable to occur. Therefore, even when the piezoelectric elements 23 of two pressure chambers 11 connected to one outflow supply path 17 are driven at the same time, the discharge state is less liable to fluctuate. Thus, according to this embodiment, by increasing the size of the outflow supply path 17 and connecting more discharge mechanism portions 15 to the outflow supply path 17 than to the inflow supply path 16, the flow resistance in the outflow supply path 17 is reduced to promote the flow of liquid in the outflow supply path 17.

Further, in this embodiment, piezoelectric elements 23 corresponding to four (at least r) discharge ports 12 arranged in succession in the Y direction are driven at different timings. Therefore, it is possible to inhibit density unevenness that appears in a recorded image due to difference in discharge state caused by the order of driving.

Note that, also in the liquid discharge head 7 according to this embodiment, the discharge ports 12 are arranged similarly to the case of the first embodiment. That is, the positions of the other discharge ports 12 in the X direction are defined as approximately An, and the positions of the other discharge ports 12 in the Y direction are defined as approximately A(m+b) ($0 \leq b < 1$). In this case, all values of b for the discharge ports 12 corresponding to the pressure chambers 11 connected to one inflow supply path 16 are different from one another. Further, at least r (four) discharge ports 12 adjacent to each other in the Y direction (see the discharge ports 12*a* to 12*d* surrounded by the dotted line) are arranged so as to be in succession when projected onto the X axis, and the respective discharge ports 12 have different values of b.

Sixth Embodiment

Figure 11:
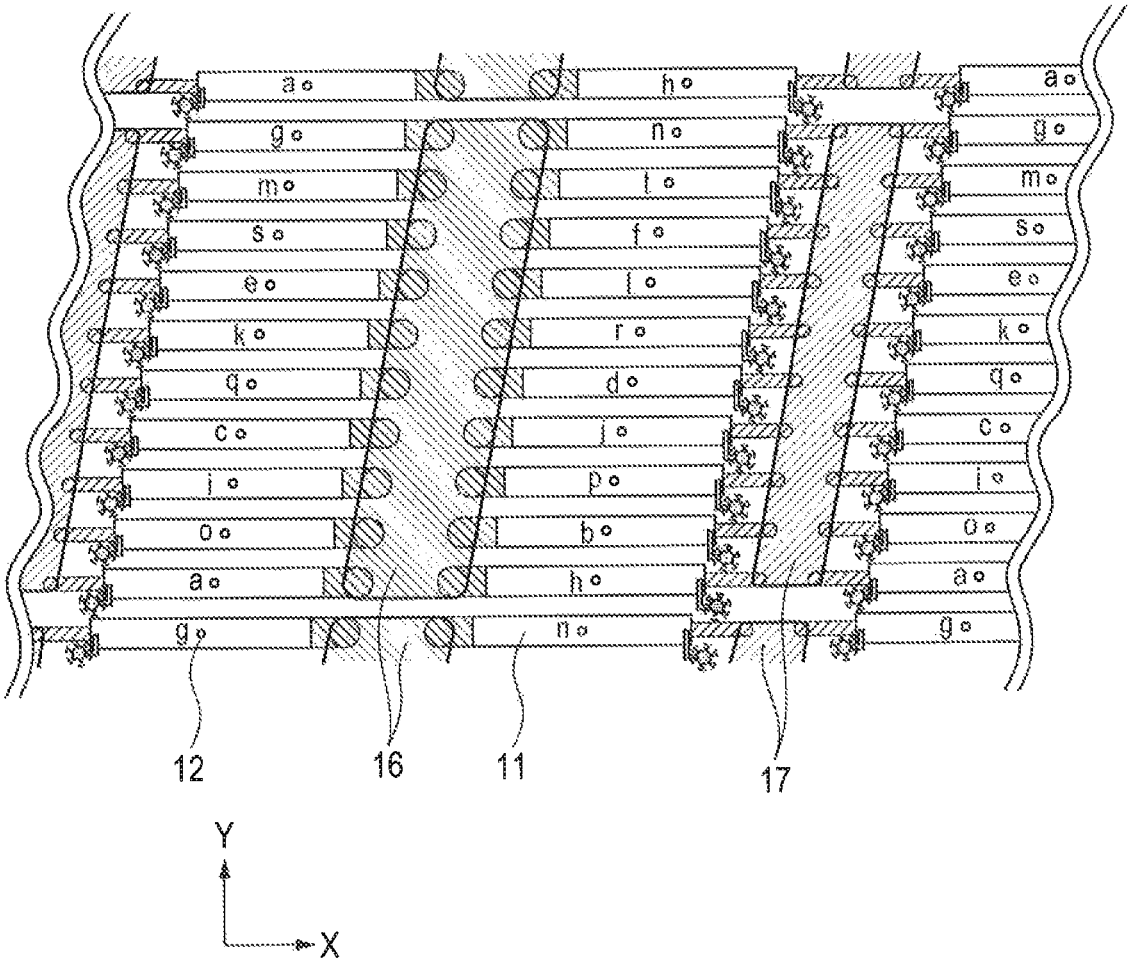
FIG. 11 is an illustration of a main structure of a liquid discharge head according to a sixth embodiment of the present invention.

FIG. 11 is an illustration of a main structure of the liquid discharge head 7 according to a sixth embodiment of the present invention.

In this embodiment, as illustrated in FIG. 11, twenty pressure chambers 11 are connected to one inflow supply path 16 via the inflow flow paths 13. Further, twenty pressure chambers 11 are connected to one outflow supply path 17 via the outflow flow paths 14.

Further, for example, the distance in the Y direction between a discharge port 12 corresponding to a and a discharge port 12 corresponding to o, the distance in the Y direction between a discharge port 12 corresponding to g and a discharge port 12 corresponding to a, the distance in the Y direction between a discharge port 12 corresponding to h and a discharge port 12 corresponding to b are A(5+0.7). All of the distances in the Y direction between discharge ports 12 corresponding to pressure chambers 11 adjacent to each other in the Y direction are A (5+0.7). Further, all of the distances in the X direction between discharge ports 12 corresponding to pressure chambers 11 adjacent to each other in the Y direction are A.

Further, distances between discharge ports 12 at positions opposed to each other in the X direction with the inflow supply path 16 or the outflow supply path 17 sandwiched therebetween, for example, between a discharge port 12 corresponding to a and a discharge port 12 corresponding to h, are 40 A in the X direction and 0.35 A in the Y direction, respectively.

The driving unit 5 drives piezoelectric elements 23 of a plurality of pressure chambers 11 connected to one supply path in the order of a, b, c, d, e, f, g, h, i, j, k, 1, m, n, o, p, q, r, s, and t illustrated in FIG. 11. Therefore, also in this embodiment, the piezoelectric elements 23 of the plurality of pressure chambers 11 connected to one supply path are not driven at the same time. Therefore, even though the sizes of the supply paths are relatively large, interference (crosstalk) among the discharge mechanism portions 15 can be reduced. Note that, in this embodiment, the large number of pressure chambers 11 are connected to the same pressure chamber 11 via the inflow supply path 16 and the outflow supply path 17. Therefore, an effect of dispersing an influence of crosstalk is small. However, the size of the supply path can be increased, and thus, by reducing the flow resistance in the supply path, crosstalk can be made relatively small.

Note that, in the embodiment described above, a case in which two flow paths (inflow flow path 13 and outflow flow paths 14) are provided for one pressure chamber 11 is described, but the present invention is not limited thereto. Only one flow path may be provided for one pressure chamber 11. In this case, as the supply path, only the inflow supply path 16 is necessary, and the pressure chamber 11 is connected to the inflow supply path 16 via the one flow path.

Note that, in the embodiments described above, a device configured to conduct recording on the recording paper 1 by discharging liquid through the liquid discharge head 7 is described as an example, but the present invention can also be applied to, for example, a production apparatus configured to form a wiring pattern by forming a pattern with a conductive liquid on a resin substrate or the like. In the cases described above, the present invention is exemplified by a device configured to discharge liquid while a recording object is moved with the liquid discharge head 7 fixed to the liquid discharge apparatus 10, but the present invention is not limited thereto. The present invention can also be applied to, for example, a serial liquid discharge apparatus configured to conduct recording while the liquid discharge head 7 moves with respect to a recording object According to the present invention, fluctuations of the discharge state can be inhibited.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-175514, filed Aug. 29, 2014, which is hereby incorporated by reference herein in its entirety.

What is claimed is:

1. A liquid discharge apparatus, comprising:

a liquid discharge head comprising:

a substrate;

a plurality of pressure chambers two-dimensionally provided on a first surface side of the substrate;

a discharge port, a pressure generating unit configured to discharge liquid through the discharge port, and a flow path connected to the pressure chamber, which are provided correspondingly to each of the plurality of pressure chambers;

a common liquid chamber provided on a second surface side of the substrate; and a plurality of supply paths provided between adjacent ones of the plurality of pressure chambers and connected to the common liquid chamber;

a moving unit configured to relatively move the liquid discharge head and a recording object; and a driving unit configured to drive the pressure generating units, wherein flow paths respectively corresponding to the plurality of pressure chambers adjacent to the supply paths are connected to the supply paths, wherein the driving unit outputs drive signals to the pressure generating units respectively corresponding to the plurality of pressure chambers connected to the supply paths at different timings, wherein the pressure chambers having the flow paths connected to one of the supply paths are provided at vertices of a quadrangle having a center corresponding to a center of the one of the supply paths, wherein, when a plane in which a plurality of discharge ports corresponding to the plurality of pressure chambers are provided is taken as an X-Y plane, and a direction in which the liquid discharge head and the recording object are relatively moved is taken as a Y direction, a flow path corresponding to each of an even number of pressure chambers that sandwich the supply path in an X direction is connected to the supply path, and wherein the driving unit drives, alternately in the X direction, pressure generating units respectively corresponding to the even number of pressure chambers connected to the supply path.

2. A liquid discharge apparatus according to claim 1, wherein the common liquid chamber comprises a first common liquid chamber and a second common liquid chamber, wherein the plurality of supply paths comprise a first supply path connected to the first common liquid chamber and a second supply path connected to the second common liquid chamber, wherein the liquid discharge head further comprises a first flow path connected to the first supply path and a second flow path connected to the second supply path, which are provided correspondingly to each of the plurality of pressure chambers, wherein the pressure chambers having the first flow path connected to the first supply path are provided at vertices of a quadrangle having a center corresponding to a center of the first supply path, wherein the pressure chambers having the second flow path connected to the second supply path are provided at vertices of a quadrangle having a center corresponding to a center of the second supply path, wherein a pressure chamber connected to other pressure chambers via the first supply path is different from a pressure chamber connected to other pressure chambers via the second supply path, and wherein the driving unit outputs drive signals to pressure generating units respectively corresponding to the plurality of pressure chambers connected to the first supply path at different timings, and outputs drive signals to pressure generating units respectively corresponding to the plurality of pressure chambers connected to the second supply path at different timings.

3. A liquid discharge apparatus according to claim 1, wherein, when A is a constant, n and m are integers, and one of the plurality of the discharge ports is taken as an origin point, positions of the plurality of the discharge ports in the X direction are each defined as approximately An, and positions of the plurality of the discharge ports in the Y direction are each defined as approximately A(m+b), where $0 \leq b < 1$, wherein values of b defining the positions of the discharge ports corresponding to the plurality of pressure chambers connected to one of the plurality of supply paths are different from one another, and wherein, when v is a relative moving speed of the recording object, $\Delta b$ is a difference between the discharge ports, the values of b defining positions in the Y direction of the discharge ports respectively corresponding to the plurality of pressure chambers connected to one of the plurality of supply paths, and $\Delta t$ is a timing difference of outputting the drive signals to the pressure generating units respectively corresponding to the plurality of pressure chambers, $\Delta t$ is approximately defined as $\Delta t = A \times \Delta b / v$.

4. A liquid discharge apparatus according to claim 1, wherein flow paths respectively corresponding to p pressure chambers adjacent to the supply paths are connected to the supply paths, wherein the driving unit has at least p kinds of output timings of drive signals in one discharge cycle, and outputs drive signals to the pressure generating units respectively corresponding to the plurality of pressure chambers connected to the supply paths at different timings, and wherein the driving unit outputs, at different timings, drive signals to the pressure generating units corresponding to at least p discharge ports that are arranged in succession when projected onto an X axis.

5. A liquid discharge apparatus according to claim 4, wherein, when A is a constant, n and m are integers, and one of the discharge ports is taken as an origin point, positions of the plurality of the discharge ports in the X direction are each defined as approximately An, and positions of the plurality of the discharge ports in the Y direction are each defined as approximately A(m+b), where $0 \leq b < 1$, wherein values of b defining the positions in the Y direction of the discharge ports respectively corresponding to the p pressure chambers connected to the supply paths are different from one another, and wherein, when v is a relative moving speed of the recording object, Δb is a difference in the values of b between the discharge ports for the discharge ports respectively corresponding to the plurality of pressure chambers connected to the supply paths, and Δt is a timing difference of outputting the drive signals to the pressure generating units respectively corresponding to the plurality of pressure chambers, Δt is approximately defined as $\Delta t = A \times \Delta b / v$.

6. A liquid discharge apparatus according to claim 1, wherein the common liquid chamber comprises a first common liquid chamber and a second common liquid chamber, wherein the plurality of supply paths comprise a first supply path connected to the first common liquid chamber and a second supply path connected to the second common liquid chamber, wherein the liquid discharge head further comprises a first flow path connected to the first supply path and a second flow path connected to the second supply path, which are provided correspondingly to each of the plurality of pressure chambers, wherein first flow paths respectively corresponding to p pressure chambers adjacent to the first supply path are connected to the first supply path, wherein second flow paths respectively corresponding to q pressure chambers adjacent to the second supply path are connected to the second supply path, wherein, when r is a value of a smaller one of p and q, the driving unit has at least r kinds of output timings of drive signals in one discharge cycle, and outputs the drive signals to the pressure generating units respectively corresponding to the plurality of pressure chambers connected to the supply paths at least r kinds of timings, and wherein the driving unit outputs, at different timings, drive signals to the pressure generating units corresponding to at least r discharge ports that are arranged in succession when projected onto an X axis.

7. A liquid discharge apparatus according to claim 6, wherein a pressure chamber connected to other pressure chambers via the first supply path is different from a pressure chamber connected to other pressure chambers via the second supply path.

8. A liquid discharge apparatus according to claim 6, wherein, when A is a constant, n and m are integers, and one of the discharge ports is taken as an origin point, positions of the plurality of the discharge ports in the X direction are each defined as approximately An, and positions of the plurality of the discharge ports in the Y direction are each defined as approximately A(m+b), where $0 \leq b < 1$, wherein values of b defining the positions in the Y direction of the discharge ports respectively corresponding to the p pressure chambers connected to the supply paths are different from one another, and wherein, when v is a relative moving speed of the recording object, Δb is a difference between the discharge ports, the values of b defining positions in the Y direction of the discharge ports respectively corresponding to the plurality of pressure chambers connected to one of the plurality of supply paths, and Δt is a timing difference of outputting the drive signals to the pressure generating units respectively corresponding to the plurality of pressure chambers, Δt is approximately defined as $\Delta t = A \times \Delta b / v$.

9. A liquid discharge head, comprising:

a substrate;

a plurality of pressure chambers two-dimensionally provided on a first surface side of the substrate;

a discharge port, a pressure generating unit configured to discharge liquid through the discharge port, and a first flow path and a second flow path each connected to the pressure chambers, which are provided correspondingly to each of the plurality of pressure chambers;

a first common liquid chamber and a second common liquid chamber that are provided on a second surface side of the substrate;

a first supply path provided between adjacent ones of the plurality of pressure chambers and connected to the first common liquid chamber; and a second supply path provided between adjacent ones of the plurality of pressure chambers and connected to the second common liquid chamber, wherein the first flow path corresponding to each of the plurality of pressure chambers adjacent to the first supply path is connected to the first supply path, wherein the second flow path corresponding to each of the plurality of pressure chambers adjacent to the second supply path is connected to the second supply path, and wherein a pressure chamber connected to other pressure chambers via the first supply path is different from a pressure chamber connected to other pressure chambers via the second supply path.

10. A liquid discharge head according to claim 9, wherein pressure chambers having the corresponding first flow path connected to the first supply path are provided at each vertex of a quadrangle having a center corresponding to a center of the first supply path, and wherein pressure chambers having the corresponding second flow path connected to the second supply path are provided at each vertex of a quadrangle having a center corresponding to a center of the second supply path.

11. A liquid discharge head according to claim 9, wherein, when a plane in which a plurality of discharge ports corresponding to the plurality of pressure chambers are provided is taken as an X-Y plane, a direction in which the liquid discharge head and a recording object are relatively moved is taken as a Y direction, A is a constant, n and m are integers, and one of the plurality of the discharge ports is taken as an origin point, positions of the plurality of the discharge ports in an X direction are each defined as approximately An, and positions of the plurality of the discharge ports in the Y direction are each defined as approximately A(m+b), where $0 \leq b < 1$, and wherein values of b defining the positions of the discharge ports corresponding to the plurality of pressure chambers connected to one of the plurality of supply paths are different from one another.

12. A liquid discharge head, comprising:

a substrate;

a plurality of pressure chambers two-dimensionally provided on a first surface side of the substrate;

a discharge port, a pressure generating unit configured to discharge liquid through the discharge port, and a flow path connected to the pressure chambers, which are provided correspondingly to each of the plurality of pressure chambers;

a common liquid chamber provided on a second surface side of the substrate; and a supply path provided between adjacent ones of the plurality of pressure chambers and connected to the common liquid chamber, wherein flow paths respectively corresponding to p pressure chambers adjacent to the supply path are connected to the supply path, wherein, when a plane in which a plurality of discharge ports corresponding to the plurality of pressure chambers are provided is taken as an X-Y plane, a direction in which the liquid discharge head and a recording object are relatively moved is taken as a Y direction, A is a constant, n and m are integers, and one of the plurality of the discharge ports is taken as an origin point, positions of the plurality of the discharge ports in an X direction are each defined as approximately An, and positions of the plurality of the discharge ports in the Y direction are each defined as approximately A(m+b), where $0 \leq b < 1$, wherein values of b for the discharge ports corresponding to the plurality of pressure chambers connected to one of the plurality of supply paths are different from one another, and wherein at least p discharge ports that are arranged in succession when projected onto an X axis have different values of b.

13. A liquid discharge head according to claim 12, wherein the common liquid chamber comprises a first common liquid chamber and a second common liquid chamber, wherein the supply path comprises a first supply path connected to the first common liquid chamber and a second supply path connected to the second common liquid chamber, wherein the liquid discharge head further comprises a first flow path connected to the first supply path and a second flow path connected to the second supply path, which are provided correspondingly to each of the plurality of pressure chambers, wherein first flow paths respectively corresponding to p pressure chambers adjacent to the first supply path are connected to the first supply path, wherein second flow paths respectively corresponding to q pressure chambers adjacent to the second supply path are connected to the second supply path, wherein, when r is a value of a smaller one of p and q, there are at least r kinds of values of b for each of the discharge ports respectively corresponding to the p pressure chambers connected to the first supply path and for each of the discharge ports respectively corresponding to the q pressure chambers connected to the second supply path, and wherein at least r discharge ports that are arranged in succession when projected onto the X axis have different values of b.

14. A liquid discharge head according to claim 13, wherein a pressure chamber connected to other pressure chambers via the first supply path is different from a pressure chamber connected to other pressure chambers via the second supply path.

* * * * *